US007900927B1

(12) United States Patent
Bliehall

(10) Patent No.: US 7,900,927 B1
(45) Date of Patent: Mar. 8, 2011

(54) PORTABLE, CARRIAGE DRIVEN, MOVING TARGET SYSTEM FOR TRAINING IN MARKSMANSHIP AND TARGET IDENTIFICATION

(76) Inventor: James Bliehall, Cedar Crest, NM (US)

( * ) Notice: Subject to any disclaimer, the term of this patent is extended or adjusted under 35 U.S.C. 154(b) by 0 days.

(21) Appl. No.: 12/346,420

(22) Filed: Dec. 30, 2008

Related U.S. Application Data

(60) Provisional application No. 61/009,646, filed on Dec. 31, 2007.

(51) Int. Cl.
*F41J 9/00* (2006.01)

(52) U.S. Cl. ..... 273/359; 273/405; 273/390

(58) Field of Classification Search ..... 273/359, 273/366–371, 403–410
See application file for complete search history.

(56) References Cited

U.S. PATENT DOCUMENTS

| | | | | | |
|---|---|---|---|---|---|
| 879,670 | A | * | 2/1908 | Petry | 273/406 |
| 2,726,870 | A | * | 12/1955 | Auger | 273/370 |
| 3,128,096 | A | * | 4/1964 | Hammond et al. | 273/367 |
| 3,586,331 | A | * | 6/1971 | Tickell, Jr. | 273/359 |
| 3,844,561 | A | * | 10/1974 | Renault | 273/369 |
| 3,865,373 | A | * | 2/1975 | Knight | 273/369 |
| 4,029,318 | A | | 6/1977 | Boss | |
| 4,614,345 | A | | 9/1986 | Doughty | |
| 4,625,973 | A | * | 12/1986 | Dallaire | 273/366 |
| 4,657,511 | A | | 4/1987 | Allard et al. | |
| 4,691,925 | A | | 9/1987 | Scholem | |
| 4,743,032 | A | * | 5/1988 | Summers et al. | 273/372 |
| 5,163,689 | A | | 11/1992 | Bateman | |
| 5,242,172 | A | * | 9/1993 | Bateman | 273/369 |
| 5,248,150 | A | | 9/1993 | Koma | |
| 5,280,919 | A | | 1/1994 | Graham | |
| 5,310,192 | A | | 5/1994 | Miyake | |
| 5,320,358 | A | | 6/1994 | Jones | |
| 5,350,180 | A | | 9/1994 | Acock | |
| 5,427,380 | A | | 6/1995 | Hazard et al. | |
| 5,533,732 | A | * | 7/1996 | Leinen et al. | 273/375 |
| 5,568,927 | A | * | 10/1996 | Badorrek | 273/366 |
| 5,688,196 | A | | 11/1997 | O'Neil | |
| 5,775,698 | A | * | 7/1998 | Jones et al. | 273/359 |
| 5,823,779 | A | | 10/1998 | Muehle et al. | |
| 5,868,396 | A | | 2/1999 | Theissen | |
| 5,967,522 | A | | 10/1999 | Corcoran et al. | |
| 5,980,254 | A | | 11/1999 | Muehle et al. | |
| 6,162,057 | A | | 12/2000 | Westphal et al. | |
| 6,217,027 | B1 | | 4/2001 | Amrein et al. | |
| 6,325,376 | B1 | | 12/2001 | Elliott et al. | |
| 6,435,512 | B1 | | 8/2002 | Beckwith, Sr. | |
| 6,478,301 | B1 | | 11/2002 | Witmeyer | |
| 6,491,303 | B1 | | 12/2002 | Huston | |

(Continued)

*Primary Examiner* — Mark S Graham
(74) *Attorney, Agent, or Firm* — Mayback & Hoffman, P.A.; Gregory L. Mayback; Katie M. Blakley

(57) ABSTRACT

A small arms training target system including a portable, battery powered, rail guided, motor driven carriage, with stationary and moving targets connected thereto. A target-rotate control device operatively connects an electric motor and rotational arm assembly to rotate and position the target into and out of a field of view. The position is selectable by a remote control, pre-selected program, or when a sensor attached to the target is struck by a sensor. Additionally an obscuring medium is attached to the rotational arm, with a target, having on it an image of a weapon mounted behind the obscuring medium. The position of the obscuring medium is selectable to be in front of the image of a weapon, making the target a no-threat, or not in front of the target, making it a threat.

17 Claims, 4 Drawing Sheets

U.S. PATENT DOCUMENTS 6,502,820 B2 1/2003 Slifko
6,575,753 B2 6/2003 Rosa
6,604,064 B1 8/2003 Wolff et al.
6,808,177 B2 * 10/2004 Dehart ..... 273/406
2006/0255543 A1 * 11/2006 Sovine et al. ..... 273/407
2006/0290063 A1 * 12/2006 Hagar ..... 273/369
2006/0290064 A1 * 12/2006 Hagar ..... 273/392
2008/0150235 A1 6/2008 Bliehall

* cited by examiner

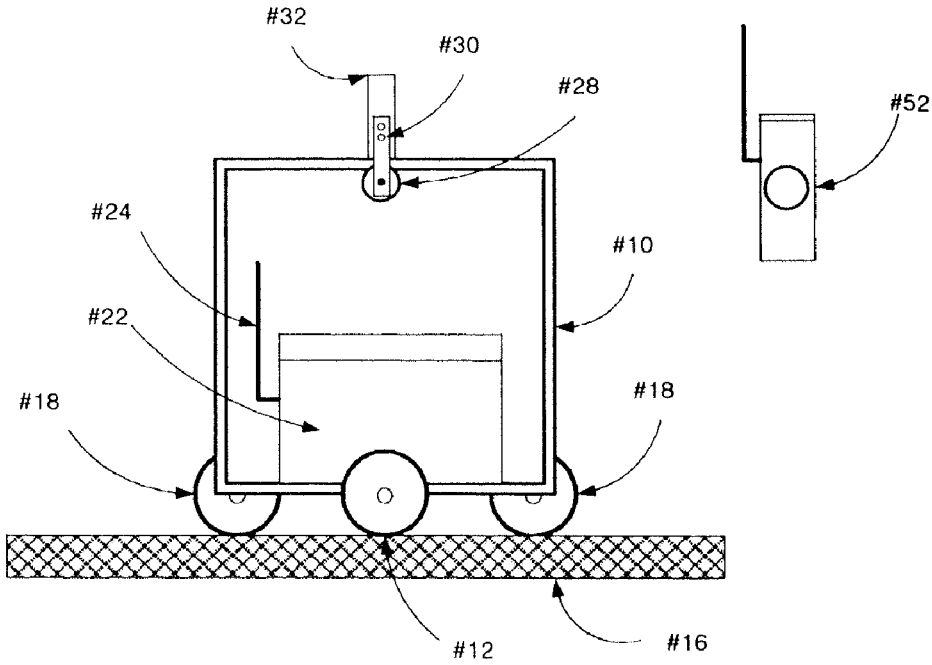
FIG # 1
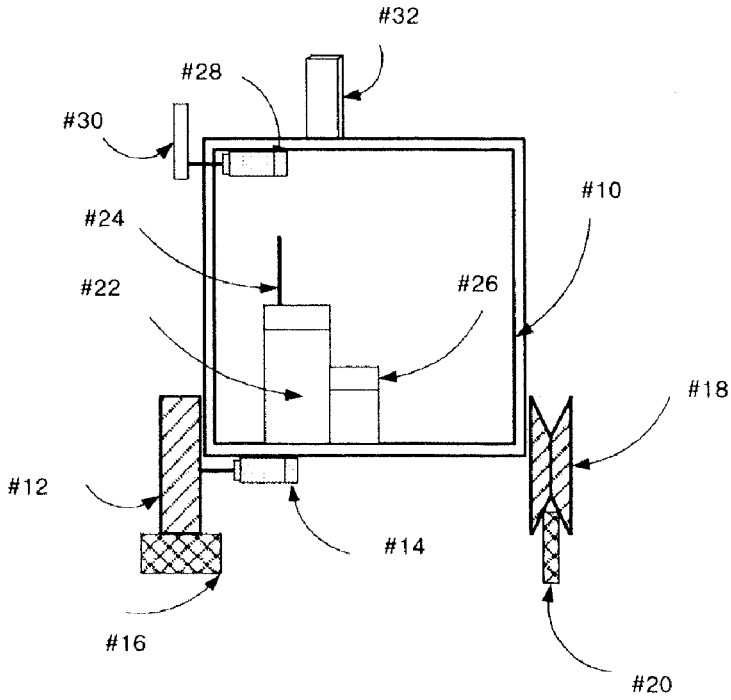
FIG # 2

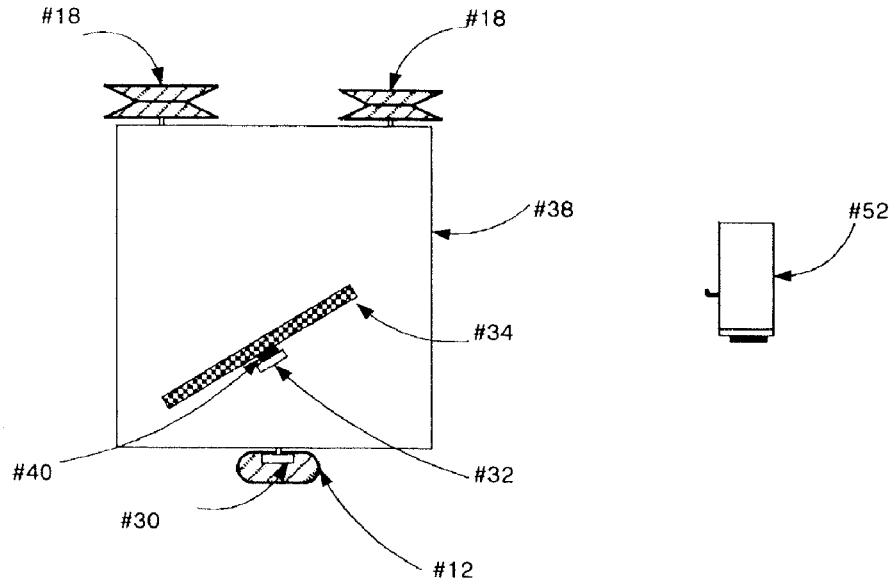
FIG # 3
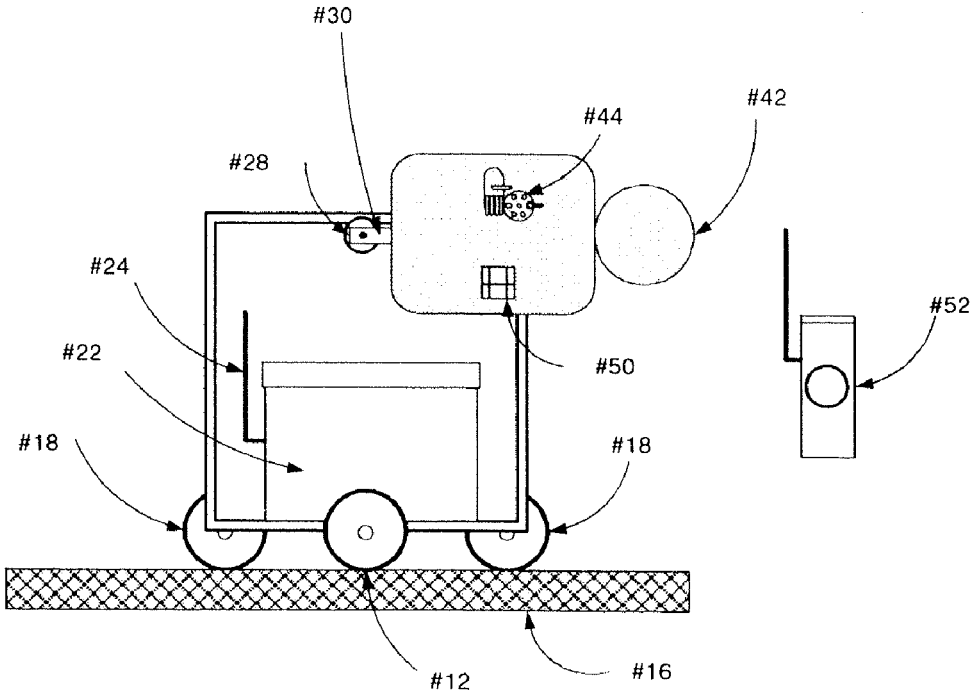
FIG # 4

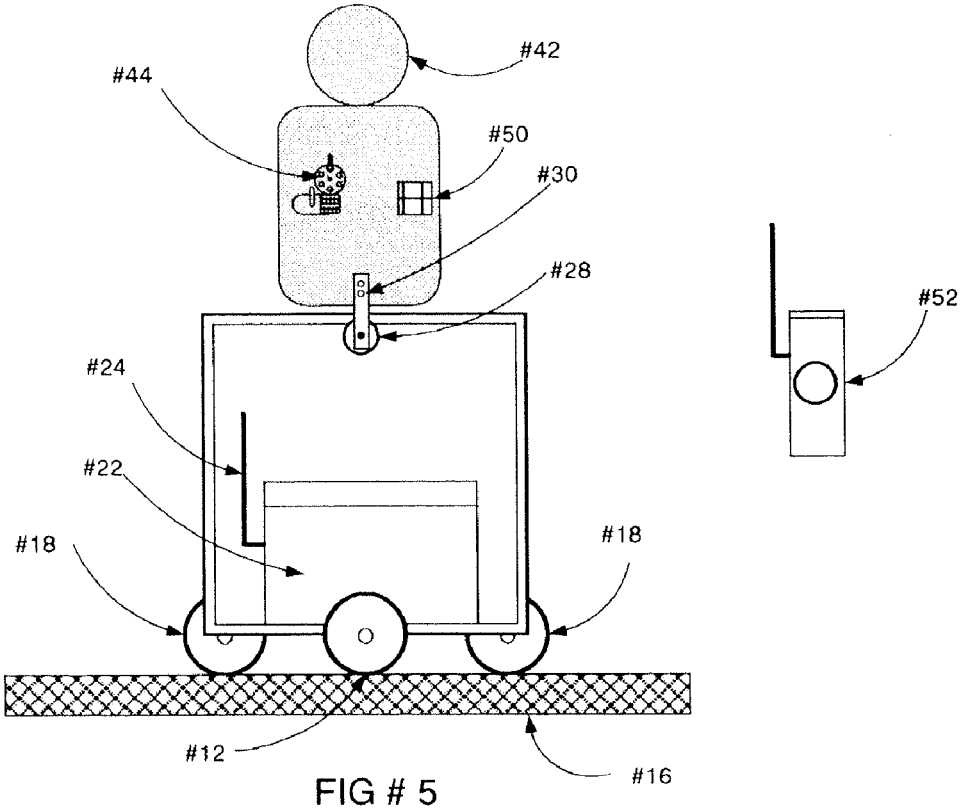
FIG # 5
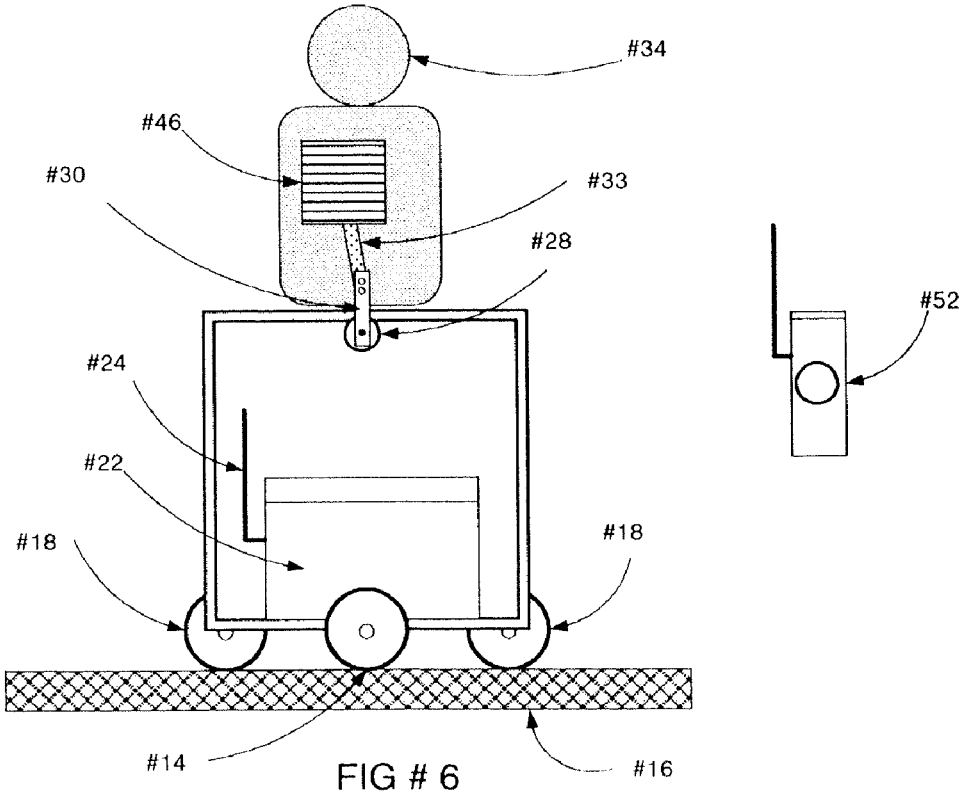
FIG # 6

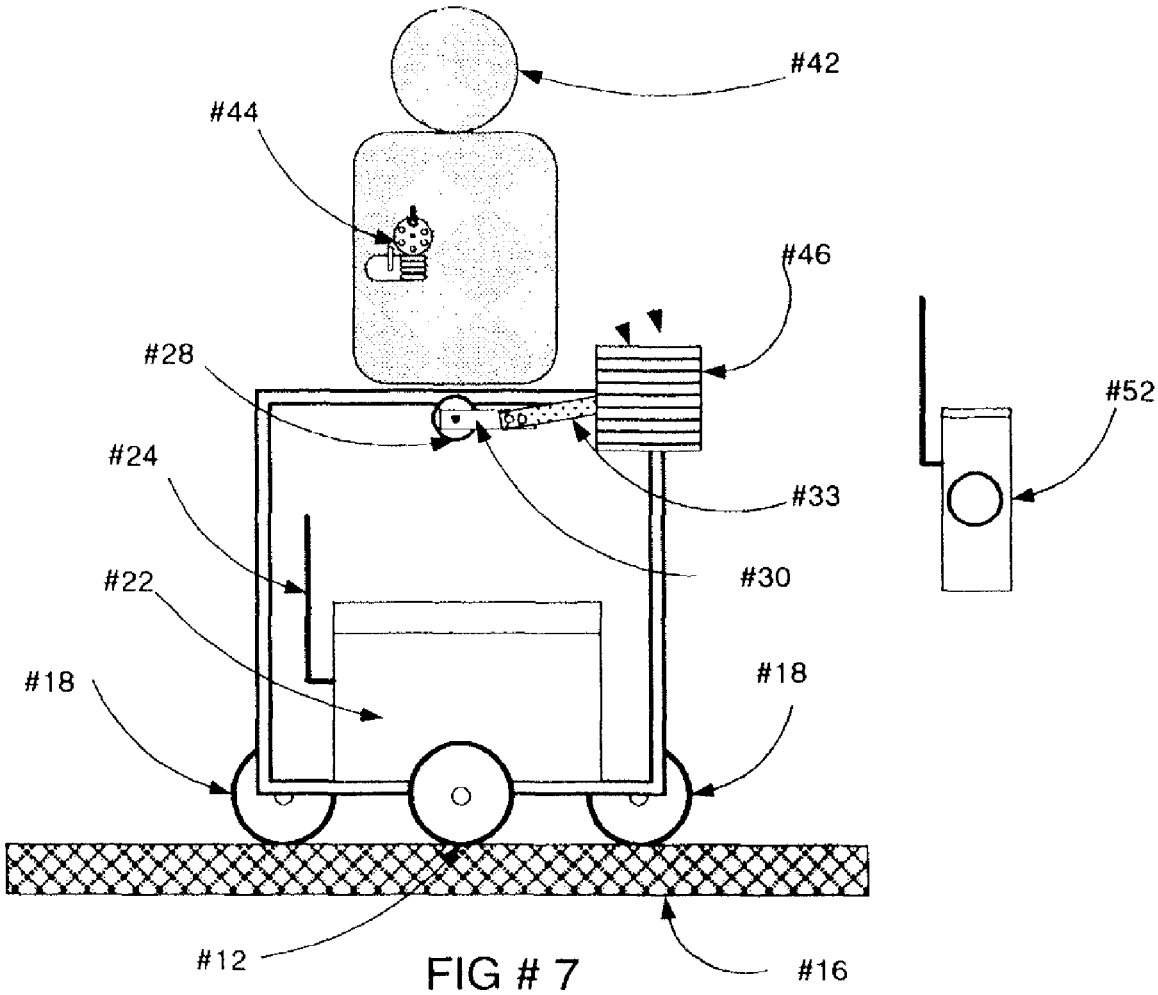
FIG # 7

PORTABLE, CARRIAGE DRIVEN, MOVING TARGET SYSTEM FOR TRAINING IN MARKSMANSHIP AND TARGET IDENTIFICATION

BACKGROUND OF THE INVENTION

1. Field of the Invention

This invention relates in general to target systems and, specifically, to marksmanship and target-identification training system using moving targets.

2. Description of Related Art

The target systems being used to train law enforcement and military shooters today are predominantly one of the following enumerated types.

A first prior art target system places a threat target image in front of the shooter and is stationary and visible at all times. Such a system has the disadvantage of allowing the shooter to constantly see the target image as a threat. There is no real-time, decisional requirement as to the threat status of the target and no dynamic indication is given to the shooter regarding their accuracy of shot placement other than by physical examination. Lastly, the target does not mimic the motions a real human person would take if they were actually shooting back.

A second prior art target system places the target image on a hanger that is moved by a driven cable. This system moves the target image at various positions toward and away from the shooter, which allows the system to decrease or increase the difficulty in hitting the target image by altering the relative size of the target. This system has the same disadvantages of the first target system described above.

A third prior art target system keeps the target image stationary but also rotates the image toward or away from the shooter. First, the target image is hidden from view (e.g., at 0 degrees of rotation). Then, the target image is rotated to face the shooter (e.g., 90 degrees). This system has a disadvantage in that the shooter knows before the target image is rotated that when presented it will be a threat target. This system has the same disadvantages of the first target system described above.

A fourth prior art system moves a target on a rail system using a steel cable driven by a high-voltage mains power source. These systems have the same disadvantages described with respect to the first system above.

A fifth prior art system moves the steel target across the ground utilizing a motor drive and steel cable assembly. This system does not offer the instructor the ability to present (at their discretion) a target that at one moment is a threat and the next moment is a no-threat; the steel target is always a threat. Because the mechanical assembly design is heavy and has a high coefficient of friction when moving across the ground, this system requires a high current mains supply and is not portable. Additionally, it is accepted that the steel target is randomly being positioned into and out of the shooters field of view relative to the condition of the terrain over which the sled is being pulled; but it cannot be accurately controlled by the operator. Lastly, the system does not afford the ability to position reactive no-threat targets adjacent to, in front of, or behind the threat target. This capability is important when training shooters so as to hone their skills not only in accuracy when using a weapon but additionally to train in target threat identification and engagement by being exposed to a system that selectively presents both threat and no-threat targets.

A sixth prior art system uses a self powered tractor to pull a trailer carrying a fixed target around a fixed course. A buried guide wire determines the path of travel of the tractor and trailer. The target is incapable of any movement other than that provided by being towed."

It would be desirable to provide a system that overcomes the disadvantages of the aforementioned systems.

SUMMARY OF THE INVENTION

The present invention is a small arms training target system. The system includes a carriage having at least one drive wheel and at least two stabilizing wheels. The drive and stabilizing wheels ride on drive and stabilizing rails, respectively. The training system is controlled through a control electronics unit carried by the carriage. A drive system for the drive wheel is carried by the carriage and controlled through the control electronics unit. A target for training is carried by the carriage.

The drive system for the drive wheel includes a battery and drive motor carried by the carriage and controlled by the control electronics unit. The carriage may have a top cover plate that carries a target mount. The target may be attached to this mount. If desired, a vibration isolation device may be positioned between the target and the mount to reduce vibration when the target is hit.

The system may include a sensor mounted on the target to signal the control electronics unit when the target is hit. The sensor providing a signal of a hit can cause an indicator light to be illuminated to allow a user to know that the target has been hit. The system may further include a rotational target motor mounted on the carriage and a target mount arm carried by the target motor. The target motor is controlled by the control electronics unit and may rotate in either direction. The target in the system may be mounted on the target mount arm. This allows movement of the target into and out of the vision of the user of the system through rotation of the target motor.

When a target is mounted on the target mount carried by the top plate, an indicia my be placed on the target as an indicator that the target is a threat and should be shot. The target mount arm may carry an obscuring medium in this case. The target motor may be activated to move the obscuring medium from a position covering the indicia to a position allowing the indicia to be seen. Thus, a threat/non-threat condition may be simulated for training purposes.

The system provides a method of small arms target training that positions a self contained internally powered carriage before a user. Then, a target is exposed to the user while moving the carriage under the control of an electronic control unit. Hits on the target are sensed and a signal given to the user that hits have been made.

Objects, advantages, novel features, and further scope of particularity of the present invention will be set forth in part in the detailed description to follow, taken in conjunction with the accompanying figures, and in part will become apparent to those skilled in the art upon examination of the following, or may be learned by practice of the invention. The objects and advantages of the invention may be realized or attained by means of the instrumentalities and combinations particularly pointed out in the appended claims.

BRIEF DESCRIPTION OF THE DRAWINGS

The accompanying drawings, which are incorporated by reference and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings:

FIG. 1 is a front elevation view of an embodiment of a target carriage assembly according to the invention.

FIG. 2 is a side elevation view of the target carriage assembly of FIG. 1.

FIG. 3 is a top plan view of the target carriage assembly of FIG. 1 with a target mounted to the rear target mount on the upper frame of the target carriage.

FIG. 4 is a front elevation view of the target carriage assembly of FIG. 1 with the target affixed to the rotational movement arm and the target and arm rotated to a down position, out of the shooter's field of view.

FIG. 5 is a front elevation view of the target carriage assembly of FIG. 1 with the target affixed to the rotational target arm and the target and arm rotated to an up position, within the shooter's field of view.

FIG. 6 is a front elevation view of the target carriage assembly of FIG. 1 with an obscuring medium affixed to the rotational movement arm and the obscuring medium and arm rotated to an up position, thereby obscuring the image of the weapon on the target changing the target to a no-threat target.

FIG. 7 is a front elevation view of the target carriage assembly of FIG. 1 with the obscuring medium affixed to the rotational movement arm and the obscuring medium and arm rotated to a down position, not obscuring the image of the weapon on the target thereby changing the no-threat target to a threat target.

DETAILED DESCRIPTION OF THE INVENTION

In FIG. 1 and FIG. 2, there is shown a target carriage assembly consisting of carriage frame (10) with a drive wheel (12) mounted to carriage drive motor (14). Drive motor (14) moves carriage frame (10) utilizing frictional contact with front support drive rail (16). Carriage frame (10) is maintained in a desired direction by means of stabilizing wheels (18) engaging rear support stabilizing rail (20).

Control electronics unit or electronics control unit (22) and associated remote RF antenna (24) are located within and carried by carriage frame (10). Power battery (26) is carried by carriage frame (10). Battery (26) is connected to and controlled by control electronics (22). Battery (26) provides power to all of the system components, including motor (14). Rotational target motor (28) is connected to rotational target mount arm (30) and rotates arm (30) in either direction when energized. Rotational motor (28) is controlled by control electronics (22). An angled rear target mount (32) may be included as shown in FIG. 1. Target arm (30) may include an extension (33) shown in FIG. 6.

In FIG. 3, target (34) is attached to rear angled target mount (32) located on upper plate (38) that covers substantially the top of carriage (10). Vibration isolator (40) is preferably positioned between target (34) and target mount (32). Vibration isolator (40) reduces the energy transmitted to carriage (10) when target (34) is hit, helping to stabilize the system when it is moving. Rear angled target mount (32) is angled to prevent the entire energy of a high-velocity projectile from being dissipated in the target (34). Energizing carriage drive motor (14) will cause target (34) to move in front of a shooter.

In FIG. 4, target (42) is attached to rotational target mount arm (30) which is connected to rotational motor assembly (28). Target (42) is shown rotated down out of a shooter's field of view, Target (42) may have on it threat indicating indicia (44), such as the image of a firearm.

In FIG. 5, target (42) is shown rotated up, into the shooter's field of view. This takes place by operation of rotational target motor (28) being operated by control electronics (22). This may be a pre-programmed sequence or may be under the control of an operator who can send signals to control electronics (22) from a remote location, the signals being received through RF antenna (24)

In FIG. 6, target (34) is mounted on rear angled target mount (32) as in FIG. 3). An obscuring medium (46) has been mounted to extension (33) of rotational target arm (30), and obscuring medium (46) has been positioned in front of the image of a weapon (48) (see FIG. 7) located on target (34). Target (34) is now not a threat.

In FIG. 7, target (34) is mounted on the rear angled target mount (32). Obscuring medium (46) under control of control electronics (22) has been positioned down and not in front of the image of a weapon (48) located on target (34). Target (34) is now a threat.

It is desirable for target (42) to move from a raised position (shown in FIG. 5) to a lowered position (see FIG. 4) after being hit by a projectile. Thus, target (42) is provided with a sensor (50) which reacts whenever target (42) is hit by a projectile. Sensor (50) may be an accelerometer with an RF transmission unit, which sends a signal to control electronics (22) when it senses a hit. The reaction may be configurable to cause the target (42) to rotate down, cause a high intensity light (52) to illuminate, or cause a sounding device (not shown) to energize. A similar sensor (50') may also be located on target (34) to give an indication of a hit on that target. In this case, the light (52) could be illuminated.

The invention has a number of distinct advantages over prior art target systems. First, by mounting the target to the rear target mount the operator is able to have the target to remain within the shooter's field of view while the carriage moves, thus providing one level of multiple levels of training for the shooter. The invention can next be configured with the target image mounted to the rotational motor assembly which has as part of its design a rotational movement arm. By energizing the rotational motor system and rotational movement arm in random directions (left and right) and random amounts of rotation (varying degrees) and varying speeds (slow, medium and fast) the target will mimic human movements, further increasing challenge and the level of shooter training. It is evident that the operator selectable parameters of these unique movements permit a wide variation of challenge levels. Simple, slow movements can be used for new shooters. More difficult, random and speedier movements can be used for advanced shooters, Further, the system can quickly change the status of the target from threat to no-threat or vice-versa; changes that occur in real life situations. This changeability requires the shooter to constantly be aware of the target's status, improving their threat recognition skills. Additionally, the system is configured to require the shooter to accurately engage single or multiple moving targets. With an ability to present two targets at one time, one in front of the other, the shooter is given the opportunity to practice engaging a threat target while avoiding the no-threat target. The targets can be arranged with the no-threat target in front and the threat target behind or vice-versa. The system can even make each target a threat target, requiring the shooter to rapidly engage both Although the invention has been described in detail with particular reference to these preferred embodiments, other embodiments can achieve the same results. Variations and modifications of the present invention will be obvious to those skilled in the art, and it is intended to cover in the appended claims all such modifications and equivalents. The entire disclosures of all references, applications, patents, and publications cited, if any, are hereby incorporated by reference.

What is claimed is:

1. A small arms training target system comprising:

a carriage;

at least one drive wheel and at least two stabilizing wheels attached to said carriage;

at least one drive rail in contact with said drive wheel and at least one stabilizing rail in contact with said stabilizing wheels;

an electronic control unit carried by said carriage;

a drive system for said drive wheel carried by said carriage and controlled by said electronic control unit for moving said carriage;

a target carried by said carriage and having indicia on said target to make said target a threat that invites a shot by a user of said system;

a rotational target motor carried by said carriage and powered by said electronic control unit for movement;

a target mount arm connected to and movable by said target motor placing said target in a target-shooting position; and an obscuring medium coupled to said target arm and rotatable by said target motor from a first position that obscures substantially only said indicia on said target while leaving said target at least partially visible to the user from a shooting location to a second position that allows viewing of said indicia on said target by the user from the shooting location.

2. The target system of claim 1 wherein said drive wheel drive system includes an electric drive motor connected to said drive wheel and a battery connected to power said drive motor.

3. The target system of claim 1 wherein said carriage includes a top plate substantially covering the top of said carriage.

4. The target system of claim 1 wherein said target mount arm angled to reduce the impact of projectiles striking said target.

5. The target system of claim 1 further including a sensor mounted on said target to signal said electronic control unit when said target is struck.

6. The target system of claim 5 further including an indicator light controlled by said electronic control unit and illuminated when a signal is received from said sensor.

7. The target system of claim 1 wherein said target is attached to said target mount arm for movement in and out of the view of a user of said target system.

8. The target system of claim 7 further including a sensor mounted on said target to signal said electronic control unit when said target is struck.

9. The target system of claim 8 wherein said target will rotate out of view of a user of said target system when said sensor detects a hit on said target.

10. The target system of claim 8 further including an indicator light controlled by said electronic control unit to be illuminated when said sensor detects a hit on said target.

11. The target system of claim 1 further including an extension portion connected to said target mount arm.

12. The target system of claim 11, wherein the obscuring medium is carried by said extension portion.

13. The target system of claim 3 further including a vibration isolator positioned between said target and said target motor.

14. A method of small arms target training, the method comprising the steps of:

positioning a self contained, internally powered carriage before a user;

placing a target in a target-shooting position, the target including a threat indicating indicia and carried by said carriage;

moving said carriage under the control of an electronic control unit;

moving an obscuring medium over said threat indicating indicia obscuring substantially only said indicia to make said target a non-threat while leaving said target at least partially visible to the user from a shooting location;

sensing hits on said target by said user; and signaling to said user when hits on said target are sensed.

15. The method of claim 14 comprising the further step of removing said obscuring medium to reveal said threat indicating indicia.

16. The method of claim 14 wherein signaling said user comprises illuminating a visible light.

17. The method of claim 14 wherein signaling said user comprises rotating said target out of said user's view.

* * * * *